United States Patent [19]

Hatagishi

[11] Patent Number: 4,573,264

[45] Date of Patent: Mar. 4, 1986

[54] METHOD AND APPARATUS FOR FEEDING SLIDERS TO SLIDER POCKET FOR ASSEMBLING SLIDERS ON AN UNCUT FASTENER CHAIN

[75] Inventor: Shingo Hatagishi, Toyama, Japan

[73] Assignee: Yoshida Kogyo K.K., Tokyo, Japan

[21] Appl. No.: 614,383

[22] Filed: May 25, 1984

Related U.S. Application Data

[62] Division of Ser. No. 430,960, Sep. 30, 1982, Pat. No. 4,466,168.

[30] Foreign Application Priority Data

Dec. 28, 1981 [JP] Japan ..... 56-214947

[51] Int. Cl.[4] ..... B21D 53/50; A41H 37/06

[52] U.S. Cl. ..... 29/766; 29/768

[58] Field of Search ..... 29/408–410, 29/766–770, 33.2

[56] References Cited

U.S. PATENT DOCUMENTS

| | | | |
|---|---|---|---|
| 3,867,755 | 2/1975 | Takamatsu | 29/408 |
| 3,945,103 | 3/1976 | Fujisaki | 29/408 |
| 4,131,993 | 1/1979 | Azzara | 29/768 |
| 4,337,877 | 7/1982 | Doori | 29/409 |
| 4,355,461 | 10/1982 | Doori | 29/768 |
| 4,437,233 | 3/1984 | Yoshieda | 29/409 |

*Primary Examiner*—Mark Rosenbaum
*Assistant Examiner*—Steven Nichols

[57] ABSTRACT

A method and apparatus for feeding sliders to a slider pocket are disclosed. Sliders taken from the pocket are assembled on the fastening element sections of an uncut fastener chain which is moved and stopped intermittently to allow the assembly of the sliders, wherein sliders longitudinally aligned and delivered by a slider chute are fed into a slider holder one at a time. The slider holder carrying a slider received from the chute is transferred to a slider assembling station from a direction at right angles to the direction of fastener chain transfer, and the slider is loaded at the slider assembling station into the slider pocket which is provided at the upper end of a slider pocket block raised from the direction at right angles to both the fastener chain transfer direction and slider transfer direction, and the slider holder is returned to the exit of the slider chute. These steps are repeated in synchronism with the stopping of movement of the uncut fastener chain. In loading the sliders into the slider pocket, the sliders are introduced from the side of the pocket so that the slider pull tab will not pose an obstacle, regardless of its shape.

1 Claim, 20 Drawing Figures

METHOD AND APPARATUS FOR FEEDING SLIDERS TO SLIDER POCKET FOR ASSEMBLING SLIDERS ON AN UNCUT FASTENER CHAIN

This application is a division of application Ser. No. 430,960, filed Sept. 30, 1982, now U.S. Pat. No. 4,466,168.

BACKGROUND OF THE INVENTION

1. Field of the Invention

This invention relates to a method and apparatus for assembling sliders on an uncut fastener chain.

An uncut fastener chain refers to a continuous length of fastener chain comprising a pair of interlocking stringers having rows of fastening elements provided on the opposing edges of the stringers alternating with gaps free of fastening elements, with a bottom stop being attached to one end of each group of interlocking fastening elements. The continuous length of fastener chain having sliders assembled thereon is cut at each of the gaps, or when necessary is cut at said gaps after a top stop is attached, to provide a fastener chain as a finished product.

The present invention is directed to a method and apparatus for feeding sliders to a slider pocket located at a slider assembling station at a stage in the operation where a slider is to be assembled on a length of fastener chain at each of the gaps of the chain.

2. Description of the Prior Art

Illustrative examples of methods and apparatus for feeding sliders are to be found in the specifications of Japanese Patent Public Disclosure No. 25854/75, U.S. Pat. No. 2,949,666, U.S. Pat. No. 3,078,558, U.S. Pat. No. 3,127,670, and U.S. Pat. No. 3,234,637. All of these disclosures rely upon systems wherein sliders are fed directly into a slider pocket from a slider chute. Regardless of the system chosen, certain disadvantages are evident:

(I) In an arrangement where the sliders are arrayed in parallel within the chute in a side-by-side relation with their shoulder portions contacting one another, the sliders are guided solely at the portion adjacent the rear opening thereof and, hence, tend to jump out of the chute. Moreover, depending upon the shape of the sliders, this method of guiding the sliders arranged in a parallel side-by-side relation cannot always be employed.

(II) In an alternative arrangement where the sliders are arranged in the chute longitudinally rather than side-by-side, the sliders can be guided more stably and the shape of the sliders is not a factor. Nevertheless, there are instances where the slider pocket cannot seize and retain sliders because of differences in the shape of the pull tab attached to the sliders.

SUMMARY OF THE INVENTION

Accordingly, an object of the present invention is to eliminate the abovementioned shortcomings encountered in the conventional method and apparatus.

A more specific object of the present invention is to provide a method and apparatus for feeding sliders to a slider pocket in a system for assembling sliders on an uncut fastener chain.

According to the present invention, these and other objects are attained by repeating the following steps in synchronism with a suspension in the transfer of an uncut fastener chain:

(a) feeding sliders intermittently into a slider holder one at a time from a slider chute which delivers the sliders while aligning them longitudinally;

(b) transferring the slider holder holding a slider to the slider assembling station from a direction perpendicular to the transfer direction of the uncut fastener chain;

(c) loading the slider at the slider assembling station into a slider pocket at the upper end of a slider pocket block which is raised from a direction perpendicular to both the direction of transfer of the uncut fastener chain and the direction of transfer of the slider; and (d) returning the slider holder to the exit of the slider chute. Such an arrangement assures that the slider will not jump out of the slider chute during the transfer of the slider, making it possible to employ a pull tab of any desired shape.

Other features and advantages of the invention will be apparent from the following description taken in conjunction with the accompanying drawings in which like reference characters designate the same or similar parts through the figures thereof.

DESCRIPTION OF THE PREFERRED EMBODIMENT

An apparatus for assembling sliders on an uncut fastener chain according to the present invention will be described with reference to the accompanying drawings.

Figure 1A:
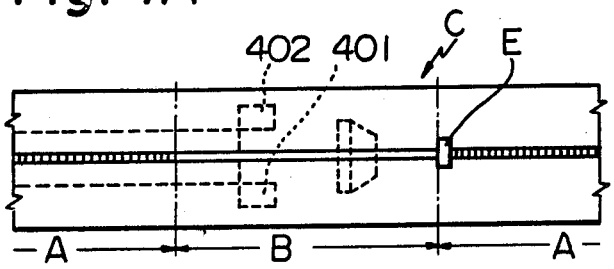
FIGS. 1(*a*) through 1(*e*) are diagrammatic views detailing the various stages for assembling a slider on an uncut fastener chain.
Figure 1B:
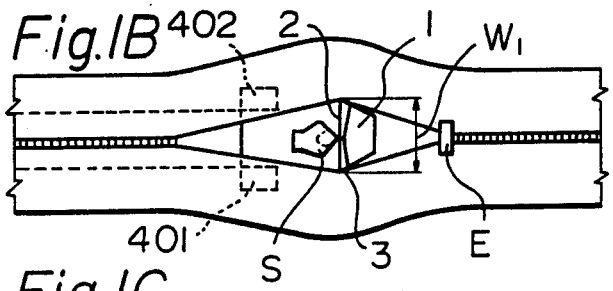
Figure 1C:
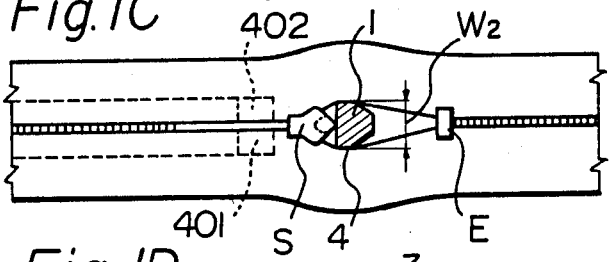
Figure 1D:
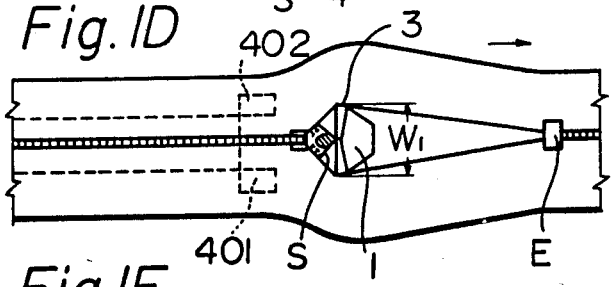
Figure 1E:
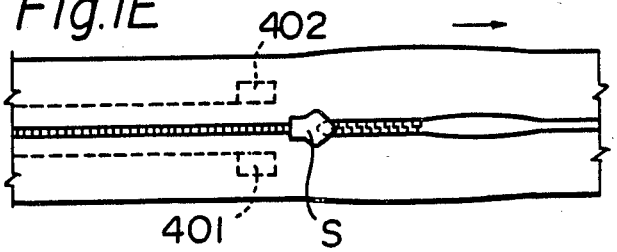
Figure 2:
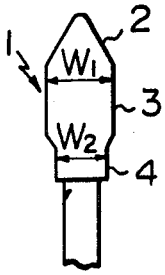
FIG. 2 is a front view showing the distal end of a spreading rod.

Referring first to the plan view of FIG. 1(*a*), an uncut fastener chain C, transferred from left to right with the rows of fastening elements facing downward, is shown stopped with a gap space B thereof positioned above a slider assembly station. The uncut fastener chain C has sections A provided with fastening elements, and bottom stops E, of which one is shown, at one end of each fastening element section. FIG. 1(*b*) is a plan view showing the pair of stringers spread apart at the gap space B of the fastener chain for the purpose of positioning a slider S between the stringer portions. To spread the stringers as shown, a spreading rod 1 having large and small width portions 3, 4 (of widths W1, W2, respectively) as illustrated in the front view of FIG. 2, is inserted into the slit between the stringers at the gap space B as far as the width portion W1. Next, in order to facilitate the later engagement between the slider S and the fastening element section A of the fastener chain, the spreading rod 1 is raised to a higher level to situate the small width portion 4 (W2) thereof between the stringers, as shown in FIG. 1(*c*). At this time, rocking guides 401, 402 (indicated by the phantom lines and described in further detail below) function to close the stringers adjacent the rear opening of the slider, thereby assuring that the later introduction of the feastening element section A into the slider S from the rear opening thereof will take place smoothly. FIG. 1(*d*) shows the uncut fastener chain C shortly after it has been transferred further to the right to just introduce the fastening element section A into and through the side channels of the slider. At such time the spreading rod 1 is lowered again so that the large width portion 3 thereof separates and spreads the rows of fastening elements of the fastening element section that has just emerged from the side channels of the slider. Specifically, the large width portion 3 serves to forcibly spread the stringers widely apart so that the separated rows of fastening elements attached thereto may be extracted from the side channels of the slider more easily. Finally, the spreading rod 1 is lowered and withdrawn completely from between the rows of fastening elements, after which the uncut fastener chain, along with the slider S assembled thereon, is transferred from left to right, as depicted in FIG. 1(*e*).

With the method described above, the uncut fastener chain is prevented from experiencing so-called chain splitting prior to its introduction into the rear opening of the slider. The foregoing method also prevents clashing between the slider and the leading end portions of the fastening element rows following their introduction into the slider, and reduces frictional resistance as a result.

Figure 3:
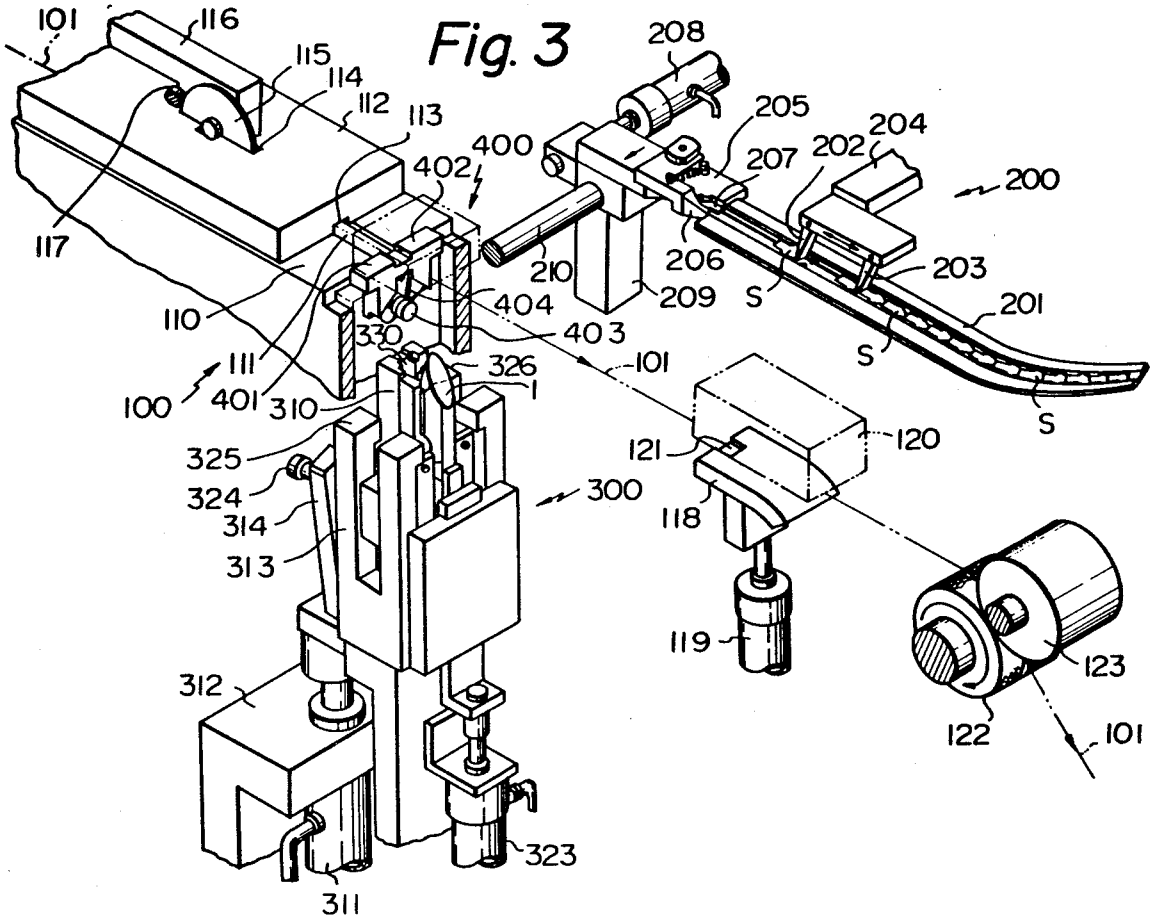
FIG. 3 is a perspective view showing an overall system suitable for practicing the method depicted in FIG. 1.

FIG. 3 is a perspective view illustrating a convenient system for practicing the method outlined above. The system is composed of an uncut fastener chain transfer device 100 for intermittent transfer of the uncut fastener chain, a slider feed apparatus 200 in accordance with the present invention, a slider assembly device 300 which includes the spreading rod 1 and a slider pocket block 310, and a rocking guide mechanism 400 for closing the stringers adjacent the back opening a slider.

The construction, operation and function of the uncut fastener chain transfer device 100 will now be described with reference to FIG. 3. An uncut fastener chain, whose center line follows the course indicated by the elongate broken line, travels in the direction of the arrows along a transfer path 101. The transfer device 100 includes a support block 110 the upper surface of which has an element guide channel 111. A guide block 112 whose lower surface is provided with an element guide channel 113 is placed on the support block 110 with its guide channel 113 in registration with the guide channel 111. The guide block 112 is provided with a slit 114 which receives a sensing roller 115 rotatably retained at one end of a sensing lever 116 supported by a pin 117. The sensing roller 115, whose outer circumference protrudes into the guide channel 113, rolls while contacting the uncut fastener chain conveyed through the element guide channels 111, 113. When a gap space on the uncut fastener chain reaches the sensing roller 115, the latter begins riding the fastener chain at a slightly lower level because of the absence of the fastening elements. The sensing lever 116 responds to this change in the level of the sensing roller 115 by producing a stop signal.

Designated at 118 is a shoe for stopping the bottom stops attached to the uncut fastener chain. The piston of a first air cylinder 119 is raised in response to the stop signal produced by the sensing lever 116, whereby the shoe 118 is elevated to press the uncut fastener chain against a plate 120 to halt the transfer of the chain. The shoe 118 includes a slot 121 for engaging with a bottom stop. A drive roller 122 and a pinch roller 123 cooperate to drive the uncut fastener chain.

Turning now to a description of the construction and operation of the slider feeding apparatus 200 of the present invention, the apparatus includes a slider chute 201, feed pawls 202, 203, a feed pawl holder 204, a slider holder 205, a rocking lever 206, a receiving plate 207, a second air cylinder 208, a slide block 209, and a guide rail 210. A multiplicity of sliders S are fed into the apparatus from the slider chute 201 in which the sliders are aligned and guided longitudinally thereof. More specifically, the pair of feed pawls 202, 203 are supported by the feed pawl holder 204 which is reciprocated longitudinally of the chute 201 in conjuction with the repetitive stop-and-go transfer of the uncut fastener chain. The sliders S are fed to the receiving plate 207 one at a time by the pair of feed pawls 202, 203 as the latter are reciprocated by the feed pawl holder 204. Though two feed pawls are described here, it goes without saying that only one will suffice. The receiving plate 207 is so located as to enter the clearance between the flanges of the upper and lower wings of the slide S, thereby guiding the slider in a stable manner. The rocking lever 206 is urged inwardly toward one side of the receiving plate 207 to prevent the slider S from slipping out of said one side. When the slider S is received and held by the slider holder 205 via the receiving plate 207 and rocking lever 206, the second cylinder 208 transports the slider holder 205 in the direction of the arrow along the guide rail 210, which is affixed to an immovable base that is not shown. The purpose of this operation will be described below along with the function of the slide block 209 which, depending from the slider holder 205, moves together therewith.

Figure 4:
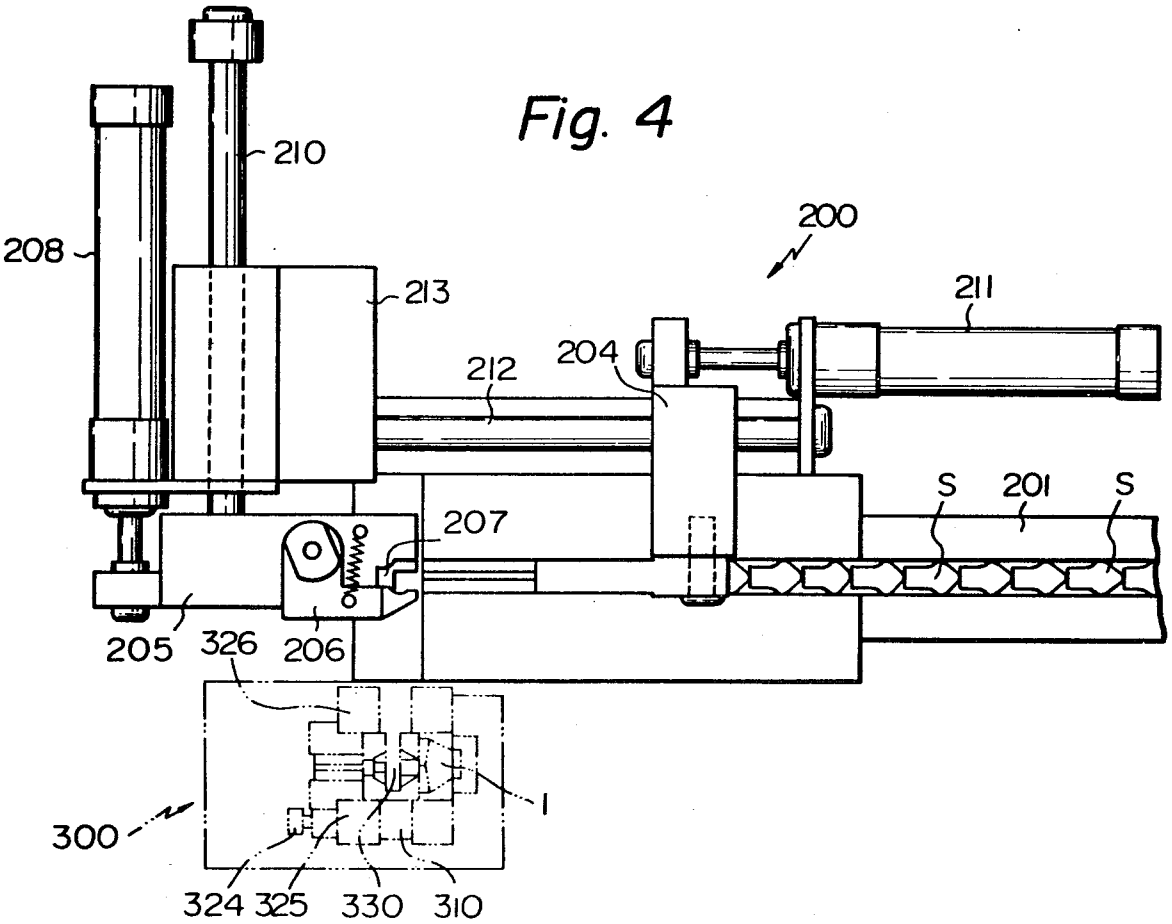
FIG. 4 is a plan view illustrating an embodiment of a slider feeding apparatus according to the present invention.
Figure 5:
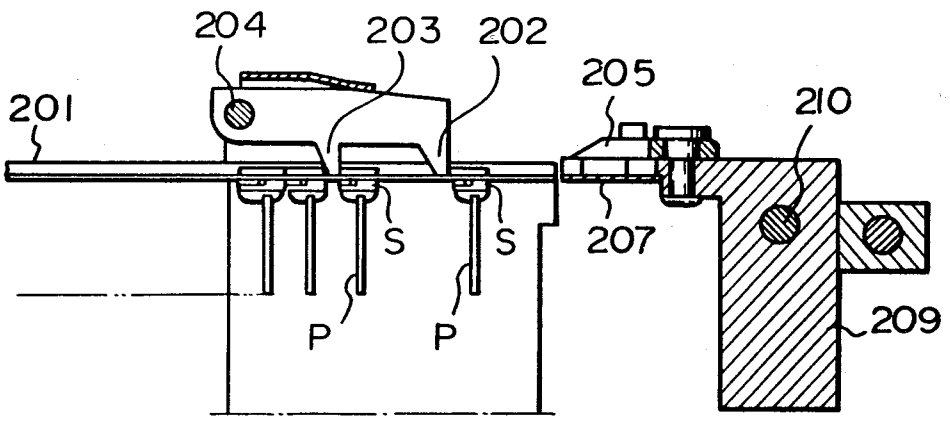
FIG. 5 is a view showing the apparatus of FIG. 4 as seen from the back thereof.

Referring now to FIGS. 4 and 5 showing an embodiment of the slider feeding apparatus according to the invention, in which FIG. 4 is a plan view and FIG. 5 is a view depicting the back of the apparatus, portions corresponding to those shown in FIG. 3 are designated by like reference numerals. Unlike the arrangement of FIG. 3, the guide rail 210 is affixed to the slider holder 205 and is guided through the bore of an immovable base 213 to which the second air cylinder 208 is secured. It may be appreciated, however, that the embodiment of FIG. 4 functions in exactly the same way as the arrangement shown in FIG. 3, notwithstanding the slight structural difference. In FIG. 4, numeral 211 denotes a third air cylinder which is not visible in FIG. 3. This air cylinder serves to reciprocate the feed pawl holder 204 along a guide rail 212 affixed to the base 213. Shown in part at the bottom of FIG. 4 is a plan view of the slider assembling device 300, indicated by the dot-and-dash line. The construction and operation of the slider assembling device 300 will be described hereinbelow, along with which the arrangement of FIG. 4 will be discussed in greater detail.

Figure 6:
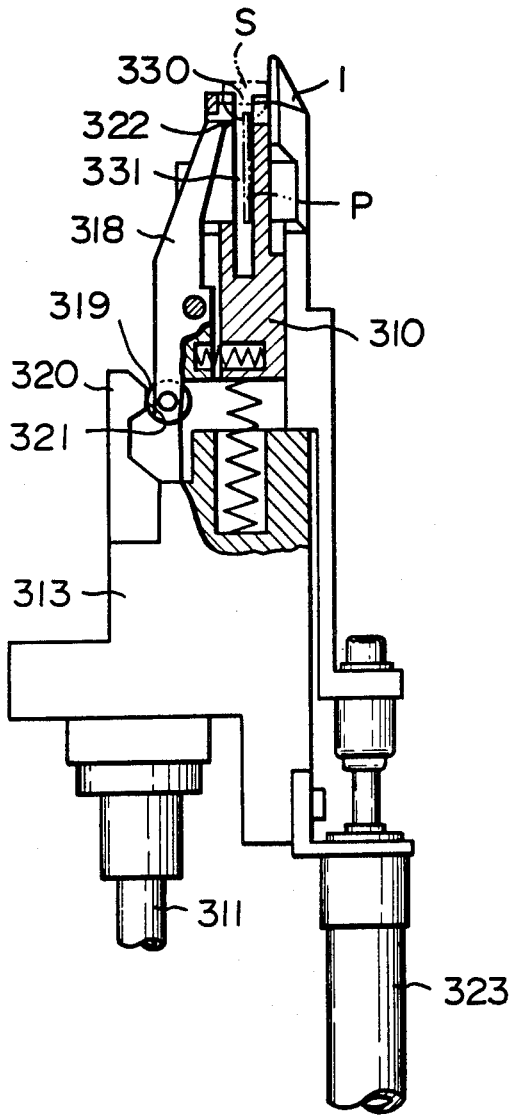
FIGS. 6 and 7 are partially sectional side and front views, respectively.
Figure 7:
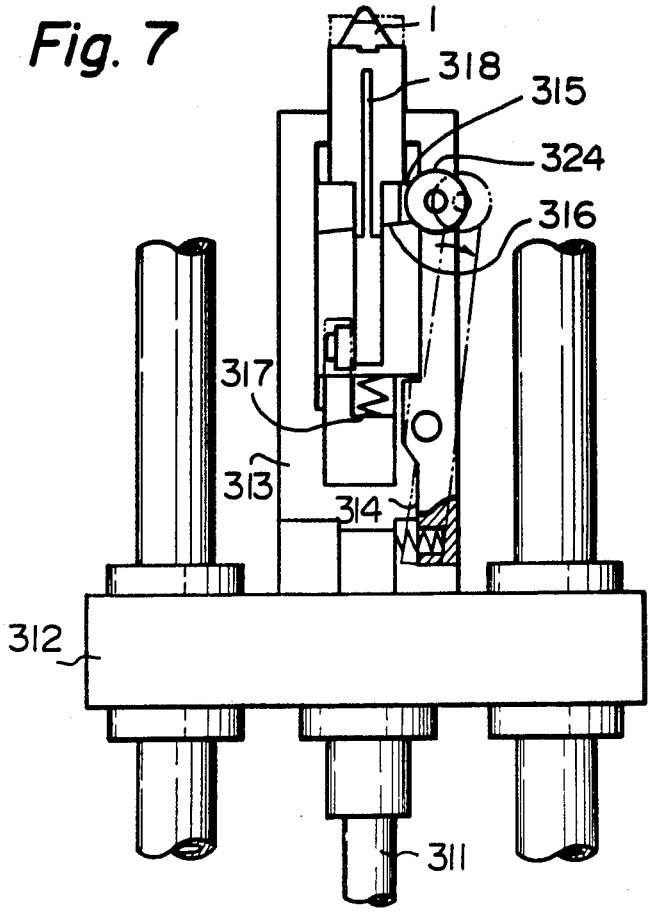
Figure 8:
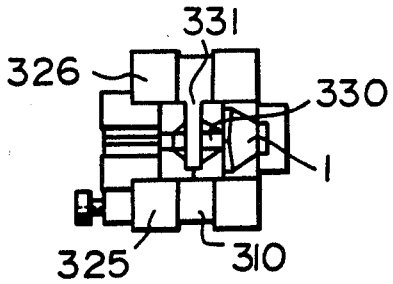
FIG. 8 is a plan view of a principal portion, illustrating an apparatus for assembling the sliders on an uncut fastener chain.

FIGS. 6 and 7 are a side view and front view, respectively, with portions partially shown in section, illustrating the slider assembling device. FIG. 7 is as seen from the upstream side of the uncut fastener chain transfer path. FIG. 8 is a plan view showing the principal portion of the slider assembling device. Further, FIGS. 9(*a*) and 9(*b*) are useful in describing the structure and operation of the rocking guide mechanism.

In the figures, the slider assembling device 300 includes the slider pocket block 310, a fourth air cylinder 311, an immovable base 312, a slider holder case 313, a locking lever 314, a hook portion 315 at the top end of the locking lever 314, a shoulder portion 316 on the slider pocket block 310, a compression spring 317, a pull tab restraining lever 318, a roller 319 at the lower end of the pull tab restraining lever 318, a cam 320 having a flat portion 321, a finger 322 on the pull tab restraining lever, and a fifth air cylinder 323. The side surface of the slider pocket block 310 has a slot 331 for directly receiving from the side thereof the pull tab P depending from the slider S. Numerals 401 and 402 (FIG. 9) denote L-shaped rocking guides, 403 a support shaft, and 404 a coil spring for biasing the rocking guides 401, 402 open, that is, away from each other.

The operation of the slider assembling device will now be described with reference to FIGS. 9 and 10, while referring also to FIG. 1.

(I) Initially, the slider holder case 313, which is capable of being driven up and down relative to the stationary base 312 by means of the air cylinder 311, is located at bottom dead center. The locking lever 314, as shown by the solid lines in FIG. 7, brings the hook portion 315 at the top end thereof in engagement with the shoulder portion 316 protruding forwardly of the slider pocket block 310 and locks the slider pocket block 310 at the lower position against the upwardly directed elastic force applied by the spring 317. At this time, the roller 319, which is attached to the lower end of the pull tab restraining lever 318 pivotally supported on the slider pocket block 310, is riding on the flat portion 321 of the cam 320, so that the finger 322 at the upper end of the lever 318 is retracted. Further, the spreading rod 1, which is capable of being driven up and down relative to the slider holder case 313 by the fifth air cylinder 323, also is at bottom dead center. The rocking guide mechanism 400 is in the open state, and the uncut fastener chain is travelling in the direction of the arrow.

(II) A slider S is delivered to the slider holder 205 via the slider chute 201 and then is transferred to the slider pocket 330 by the slider holder guided by the guide rail 210. As this is done the slide block 209 (FIG. 5) depending from the slider holder 205 strikes the roller 324 at the upper end of the locking lever 314, whereby the locking lever 314 is disengaged from the shoulder portion 316 on the front side of the slider pocket block 310. This allows the compressed spring 317 to elevate the slider pocket block 310. As a result, the roller 319 at the lower end of the pull tab restraining lever 318 is shifted to a position where it engages with an oblique portion of the cam 320, so that the finger 322 at the upper end of the lever 318 is swung toward the pull tab P of the slider S to press and retain the pull tab against a portion of the slider pocket block 310. When the slider holder 205 is returned toward the slider chute, therefore, the rocking lever 206 is opened by pressing against the firmly retained slider S, whereby said slider remains behind within the slider pocket 330. During this step no particular problem is encountered even if the uncut fastener chain is still advancing in the direction of the arrow.

(III) Next, the sensing lever 116 produces the stop signal upon sensing a gap in the uncut fastener chain, whereby the transfer of the fastener chain is halted owing to the interaction of the bottom stop engaging shoe 118 and the plate 120. Since the arrangement is so adjusted that the blank space will be positioned above the slider pocket 330 at this time, the fifth air cylinder 323 is now actuated to elevate the spreading rod 1 whose arrow-shaped distal end 2 spreads the pair of stringers apart as the spreading rod rises. With further elevation of the spreading rod 1, the large width portion 3 thereof opens the slit between the stringers to the maximum extent. The fourth air cylinder 311 then raises the slider holder case 313, with the slider pocket block 310 stopping after coming into abutting contact with an overhead plate 410. However, the upper ends 325, 326 of legs provided on the slider holder case 313 continue to rise to eventually close the L-shaped rocking guides 401, 402 against the force of the coil spring 404. This corresponds to the step illustrated in FIG. 1(*b*).

(IV) When the slider holder case 313 reaches top dead center, the roller 319 rides up and beyond the flat portion 321 of the cam 320 and is seated in a comparatively deeply recessed portion of the cam, whereby the pull tab pressing lever 318, which was pivoted to the left in step (III), is pivoted to the right, or clockwise direction, to again press the pull tab P of the slider S against the wall of the slider pocket block 310. At the same time, the upper ends 325, 326 of the legs of slider holder case 313 press upwardly against the pair of L-shaped rocking guides 401, 402, whereby the rocking guides are closed completely, as shown in FIG. 9(*b*). Meanwhile, the spreading rod 1 continues to be elevated to bring the small width portion 4 thereof into position within the slit between the pair of stringers. This places the uncut fastener chain in the condition shown in step (c) of FIG. 1. Thereafter, the shoe 118 for stopping the bottom stop is lowered and drive roller 122 is rotated to begin advancing the fastener chain, whereby the fastening element section of the chain is led into the slider. After the leading fastening elements of the fastening element section penetrate the slider, only the spreading rod 1 is lowered by the fifth air cylinder 323, so that the large width portion 3 of the spreading rod 1 may cause the rows of interlocked fastening elements to separate. The fastener chain continues to be passed through the slider S as it is being separated, until the position of the chain relative to the slider is that shown in FIG. 1(*e*). At this point, rotation of the drive roller 122 is suspended to halt the advance of the fastener chain.

Figure 9A:
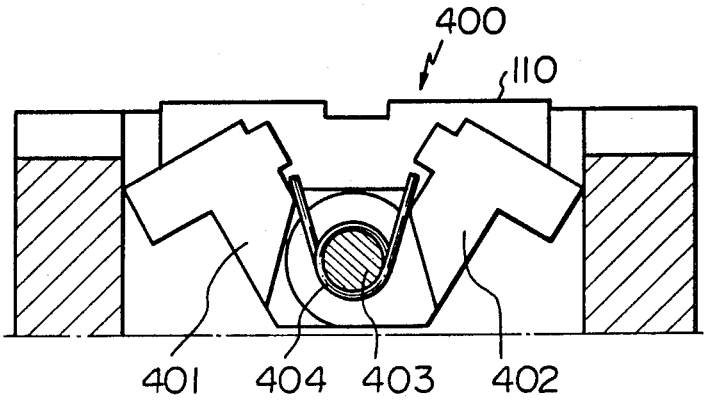
FIGS. 9(*a*) and 9(*b*)are views useful in describing a centering mechanism.
Figure 9B:
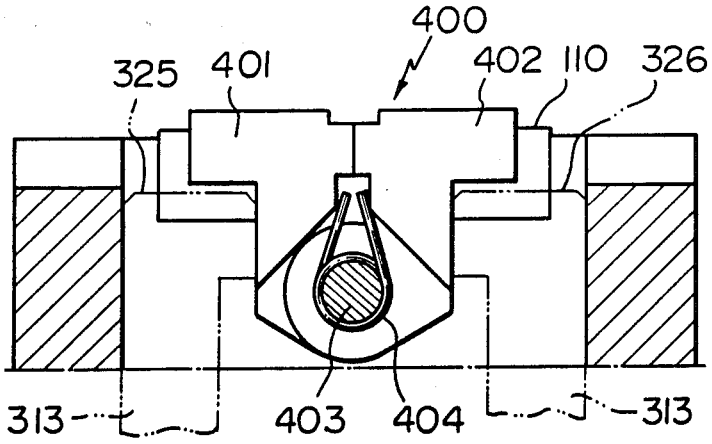

(V) Next, the slider holder case 313 begins to be lowered to retract the upper ends 325, 326 of the legs thereof from the rocking guide mechanism 400, so that the guide members 401, 402 are returned to the condition shown in FIG. 9(*a*). Although the slider holder case 313 is retracted from the slider S, the fastening element rows have already been led into the back opening of the slider S and have emerged from the side channels thereof, as shown in step (e) of FIG. 1. Therefore the slider S will not fall despite the descent of the upper ends 325, 326 of the slider holder case 313.

Figure 10A:
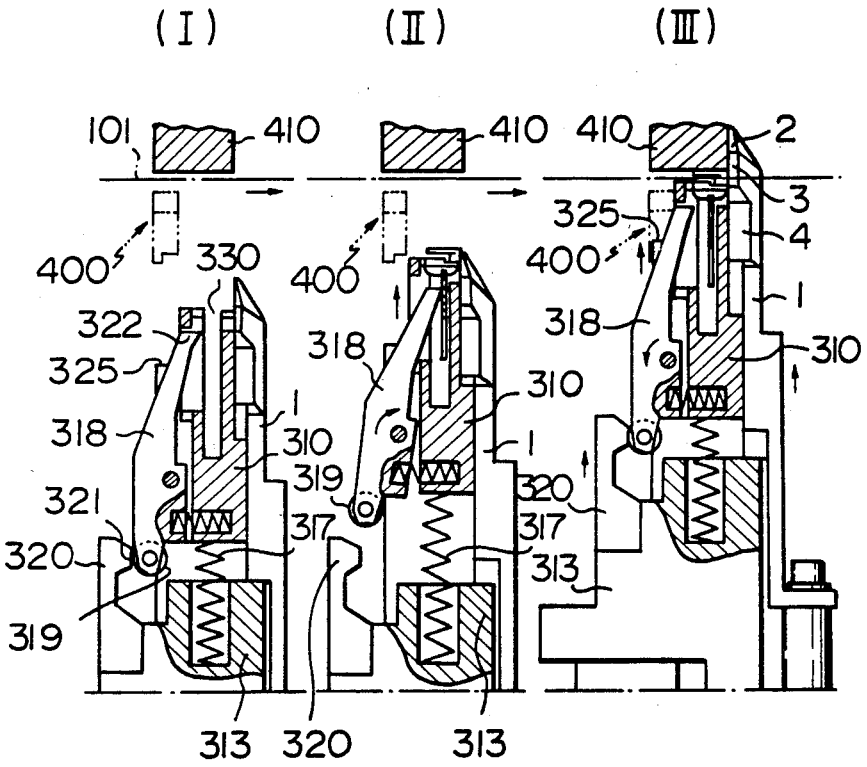
FIGS. 10(*a*) and 10(*b*) are illustrative views useful in describing the operation of the apparatus for assembling the sliders on an uncut fastener chain.
Figure 10B:
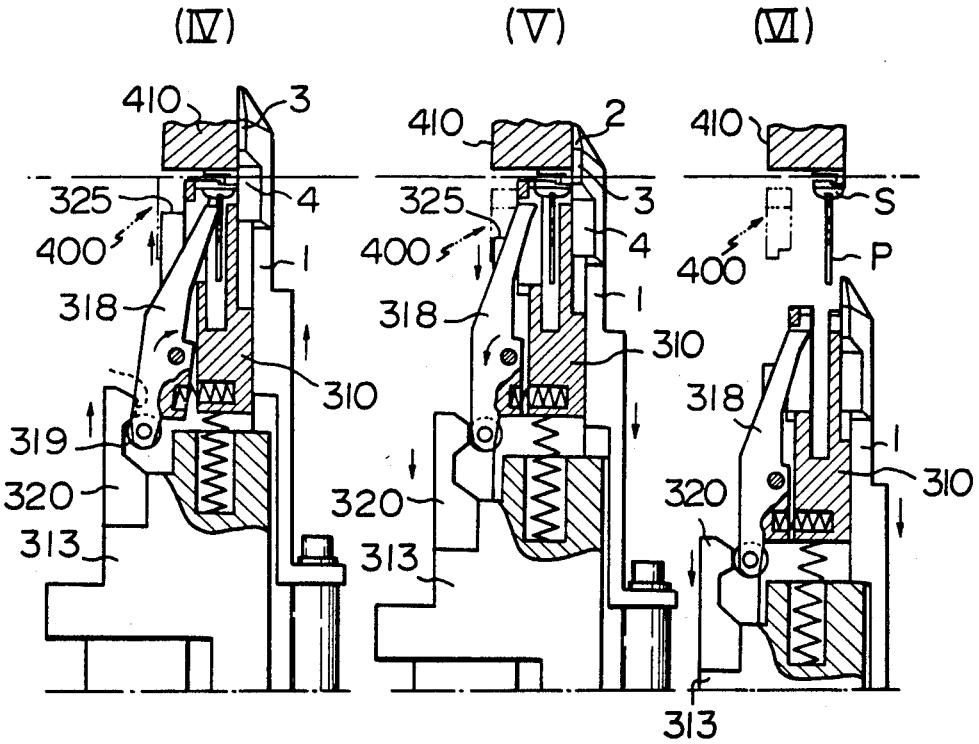

(VI) The slider holder case 313 and spreading rod 1 are lowered further to return them to the condition shown in (I) of FIG. 10. When the slider S is freed completely from the slider pocket block 310 during the descent of the slider holder case 313, the uncut fastener chain is again advanced, carrying the slider S with it, as illustrated in step (e) of FIG. 1.

Owing to the method and apparatus of the present invention having the construction and operation described as illustrated hereinabove, sliders can be fed to the slider pocket with a high degree of efficiency. Moreover, since the sliders are introduced into the slider pocket from the side thereof, the method and apparatus of the invention can be applied even to sliders having pull tabs the broad surfaces of which differ in shape.

As many apparently widely different embodiments of the present invention may be made without departing from the spirit and scope thereof, it is to be understood that the invention is not limited to the specific embodiments thereof except as defined in the appended claims.

What is claimed is:

1. An uncut fastener chain converging mechanism characterized by comprising:

a support shaft implanted in the end face of a support block for uncut fastener chain transfer directly below an element guide channel of said support block;

a pair of L-shaped pieces the ends of the longer legs whereof are loosely fitted on said support shaft, the shorter legs whereof are directed away from each other; and a coil spring wound around said support shaft, an elastic force due to straight end portions of the coil spring acting in a direction to urge said pair of L-shaped pieces away from each other;

opposing corner portions of each of the shorter legs of said pair of L-shaped pieces being provided with L-shaped cut-outs;

the opposing side faces of each of the longer legs being brought into mutual contact owing to the outer side faces of each of the longer legs of said pair of L-shaped pieces being engaged by the upper end faces of a holder case when the holder case is raised, a fastening element section of the uncut fastener chain being clamped by said cut-outs of the opposing corner portions of each of the shorter legs of the L-shaped pieces.

* * * * *